United States Patent [19]

Dottinger

[11] 3,932,896

[45] Jan. 20, 1976

[54] SWIMSUIT

[75] Inventor: Konrad Dottinger, Reutlingen, Germany

[73] Assignee: Busino & Co., Reutlingen, Germany

[22] Filed: Feb. 22, 1974

[21] Appl. No.: 444,954

[52] U.S. Cl. ..... 2/67

[51] Int. Cl.[2] ..... A41D 7/00

[58] Field of Search ..... 2/67, 238, 2.1, DIG. 1, 2/78 A, 79, 115, 77; 128/435, 431

[56] References Cited

UNITED STATES PATENTS

| | | | |
|---|---|---|---|
| 1,421,704 | 7/1922 | Mattern | 2/67 |
| 2,329,093 | 9/1943 | Sommers et al. | 2/67 X |
| 2,685,691 | 8/1954 | Artz | 2/78 A |
| 3,183,524 | 5/1965 | Hart | 2/67 |
| 3,436,762 | 4/1969 | Cahan | 2/67 |

FOREIGN PATENTS OR APPLICATIONS

| | | | |
|---|---|---|---|
| 347,905 | 5/1931 | United Kingdom | 2/67 |
| 514,414 | 11/1939 | United Kingdom | 2/67 |
| 719,873 | 11/1931 | France | 2/67 |

*Primary Examiner*—H. Hampton Hunter
*Attorney, Agent, or Firm*—Allen Owen; Vincent L. Barker, Jr.

[57] ABSTRACT

A swimsuit, particularly for women comprising a tight-fitting body having an elongated opening porous seam down the back, extending from the neck to adjacent the waist for the escape of air or water from inside the swimsuit.

5 Claims, 2 Drawing Figures

SWIMSUIT

The innovation refers to a swimsuit, especially a woman's swimsuit made out of an elastic material, for example Lycra-material or similar.

Swimsuits made out of more or less elastic materials are known. On the one hand, and for aesthetic reasons they should fit tight to the body, but most of all they should reduce the water resistance as much as possible, especially in competitive swimming and races, through the tight fit to the body.

It is known that swimmers and especially female swimmers, wear swimsuits made from a Lycra-material, which for example consists of 75% nylon and 25% Lycra (Polyurethane) and usually is produced on a knitting machine. Swimsuits made out of this kind of material have the advantage that they adapt especially well to the individual body sizes. This very strongly elastic material is very tight and therefore has only minimal air-penetration.

It has been observed that if a swimmer wearing such a swimsuit dives by means of a racing start into the water, one or more holes or creases are formed at the back- and chest cut of the swimsuit, through which air penetrates between the body and the swimsuit during the racing start. The same thing can also occur during swimming itself if, for example, the back of the swimmer gets above the water surface, or if air bubbles created during swimming penetrate between the swimsuit and the body.

It is obvious that not only can the water resistance be increased through this creation of a wrinkle in the material, but also that the air pockets between the swimsuit and the body caused by the minimal air permeability of the material (especially of a wet material) will produce an increased water resistance. These air pockets are furthermore annoying and uncomfortable and even disturb the swimming motions, so that these air pockets influence the achievements in competitive swimming, especially the speed because of the increased water resistance.

It is further undesirable that during the entry into the water and during the swimming itself, water should penetrate between the skin and the swimsuit, because this water uses energies, if it is to escape through the material of the swimsuit, which again affects the achievement and the speed during the swimming, and also increases the water resistance.

In order to overcome these difficulties it has been suggested — among other things, to cover the chest-cut and back-cut as well as the edges of the leg openings of such swimsuits with an adhesive substance prior to putting the suit on the body, so that these edges covered with the adhesive can then stick together with the skin after the suit is on the body. The gluing of the chest- and back-cut are to prevent the entry of either air or water between the swimsuit and the skin, whereas the gluing of the leg openings is only to stretch the swimsuit tightly.

The application of the adhesive and especially the gluing of the swimsuit to the skin is rather difficult and not without problems. It requires a lot of time, and it presents difficulties during the gluing itself, as well as during the removal of the glued swimsuit from the skin, which female swimmers as a rule find objectionable. If the swimsuit has been used once, the adhesive has to dry and then be removed with gasoline in order to remove skin particles and fat. The swimsuit can be used once or twice without the application of new adhesive, however the sticking power decreases in each case.

The invention tries to avoid these disadvantages and has created a swimsuit which prevents the entry of air or water between the body surface and the swimsuit during a racing start and during swimming itself, without the use of an adhesive. Furthermore, provisions were made to allow water or air to escape easily from between the body and the swimsuit, if the entry of air and water cannot be completely avoided.

This problem is solved with an invention that provides each swimsuit on its front- and back side with a bodice and a back piece that extends to the neck of the person wearing the suit.

Between the chest- and the back part of the swimsuit appropriately only a tight opening exists, which encloses the neck of the person tightly.

It is another advantage that the yoke is faced with an elastic band so that the edge of the swimsuit adheres very tightly to the neck of the person. A special feature of the invention provides that the swimsuit has at least one opening on its back part for the escape of the air.

This opening for the escape of the air is advantageously arranged along the longitudinal center line of the back part and it can be in the form of a slit or an air-porous seam. An advantage of this seam is its lattice-like structure and it can run from the top part of the back to somewhat below the waist. A width of 3 to 5 mm for this seam is considered to be especially advantageous.

The identifying objects and advantages of the invention can be seen from the following description of a preferred embodiment taken in connection with the accompanying drawing in which.

Figure 1:
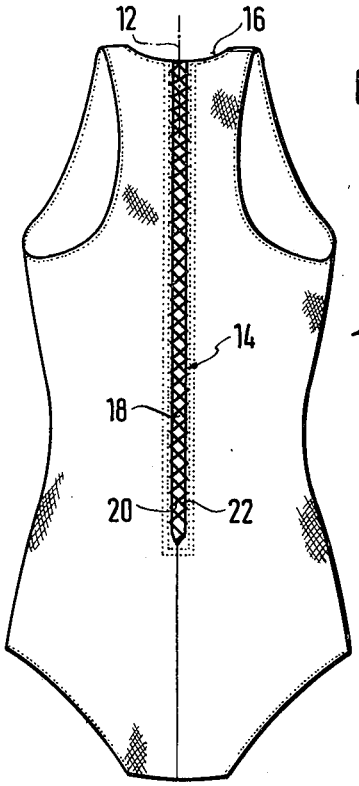
FIG. 1 is a back elevation of a swimsuit with an opened laced seam.

The swimsuit 10 according to FIG. 1 has a back part, which along the center line 12 has a slit-like opening 14 which runs from the upper end of the back part 16 to a point between the waist and the seat. If necessary, the opening 14 can, for example, stop at the waist or continue down to the seat.

This opening 14 is advantageously made in the form of an air-porous seam 18 which has a laced closure. For this purpose at least one thread 20,22 runs zigzag from each edge of the seam, across each other and are appropriately sewn to the seam edges. It may be expedient to secure the threads 20,22 to each other at these crossing points.

The width of the seam runs from about 3 mm to about 5 mm, however this measurement is not to be viewed as limiting.

This seam in the back part of the swimsuit holds it tightly together, but nevertheless permits the escape of air and water if such should penetrate between the body and the swimsuit.

Figure 2:
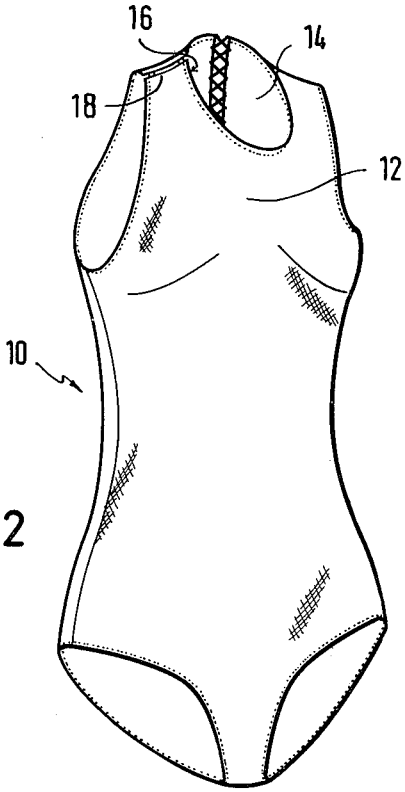
FIG. 2 is a front elevation of the swimsuit showing the high fitted yoke for the neck.

FIG. 2 shows the front of the swimsuit 10 which, for example, is made from an elastic Lycra-material and is very tightly cut so that it fits firmly and without wrinkle formation to the body of the person wearing it. The arm and leg openings are also tightly cut to obtain a tight fit. According to the invention, the swimsuit 10 extends up to the neck of the person on the front and on the back side so that a bodice 12 and the corresponding back part 14 fit tightly around the neck and the nape of the neck and enclose the neck tightly. The yoke 16 has appropriately been kept so narrow that the swimsuit encloses the neck of the person with some tension without, however, being uncomfortable or impeding the person in any way. The edge of the yoke 16 is appropriately fitted with an elastic band to further improve the fit and the tight enclosure of the swimsuit at the neck. Any suitably closed shoulder opening 18 may be provided to permit donning the swimsuit.

In some instances it may be advantageous to pull up the yoke by means of a small piping, in which case this piping can also be fitted with an elastic band to make it fit tightly and firmly around the neck of the person wearing the suit and thus prevent the entry of air and water between the body and the swimsuit.

I claim:

1. A swimsuit comprised of an elastic material adapted to snugly fit the wearer and including a waist portion of reduced diameter between a lower and an upper portion, said upper portion including front and back parts extending upwardly from said waist portion between a pair of arm cutouts and joining each other on each side of the wearer's neck to form a generally circular neck opening which encircles the wearer's neck to substantially prevent water and air from entering the suit through the neck opening with the uppermost point on said neck opening lying at the rear thereof, a narrow elongate-shaped passage below the rear of said neck opening extending centrally from said uppermost point through said back part and downwardly into and below said waist portion, and means extending throughout the length of said elongate passage for maintaining it in said narrow shape whereby air or water entering said suit may exit through said opening.

2. The swimsuit of claim 1 wherein said elongate passage is formed along a longitudinal seam of material extending centrally from the lowermost extremity of said lower portion upwardly to said neck opening.

3. The swimsuit of claim 1 wherein said elongate passage is an opening between opposed edges of said suit material held together by a continuous open lacework extending throughout the length thereof.

4. The swimsuit of claim 3 wherein said lacework extends in diagonal zigzag fashion throughout the length of said opening with each lace thread extending between said opposed edges at an oblique angle thereto.

5. A swimsuit comprised of a material adapted to snugly fit the wearer and having a generally uniform fluid porosity, said suit including a waist portion between a lower and upper portion, said upper portion including front and back parts extending upwardly from said waist portion between a pair of arm cutouts and joining each other on each side of a generally circular neck opening positioned to encircle the wearer's neck to substantially prevent water and air from entering the suit through the neck opening with the uppermost point on said neck opening lying at the rear thereof, and an elongate area below the rear of said neck opening extending centrally from said uppermost point through said back part and downwardly into and below said waist portion, said elongate area being of substantially increased fluid porosity with respect to the remainder of said suit and being of narrow width whereby air or water entering said suit may exit through said elongate area.

* * * * *

UNITED STATES PATENT OFFICE

CERTIFICATE OF CORRECTION

Patent No. 3,932,896 Dated January 20, 1976

Inventor(s) Konrad Dottinger

It is certified that error appears in the above-identified patent and that said Letters Patent are hereby corrected as shown below:

Name of assignee should read:

-- Busing & Co. --.

Signed and Sealed this

*thirtieth* Day of *March 1976*

[SEAL]

*Attest:*

RUTH C. MASON
*Attesting Officer*

C. MARSHALL DANN
*Commissioner of Patents and Trademarks*